US012054302B2

(12) United States Patent
Opitz

(10) Patent No.: US 12,054,302 B2
(45) Date of Patent: Aug. 6, 2024

(54) METHOD FOR AUTOMATICALLY CREASING A FOLDED BOX HAVING INSERTED PACKAGED GOODS

(71) Applicant: Opitz Packaging Systems GmbH, Kalefeld (DE)

(72) Inventor: Günther Opitz, Kalefeld (DE)

(73) Assignee: Opitz Packaging Systems GmbH, Kalefeld (DE)

( * ) Notice: Subject to any disclaimer, the term of this patent is extended or adjusted under 35 U.S.C. 154(b) by 198 days.

(21) Appl. No.: 17/774,416

(22) PCT Filed: Oct. 16, 2020

(86) PCT No.: PCT/EP2020/079211

§ 371 (c)(1),
(2) Date: Feb. 1, 2023

(87) PCT Pub. No.: WO2021/089302

PCT Pub. Date: May 14, 2021

(65) Prior Publication Data

US 2023/0159207 A1 May 25, 2023

(30) Foreign Application Priority Data

Nov. 5, 2019 (DE) ..... 10 2019 129 790.7

(51) Int. Cl.
*B65B 59/00* (2006.01)
*B65B 7/20* (2006.01)

(52) U.S. Cl.
CPC ..... *B65B 59/001* (2019.05); *B65B 7/20* (2013.01)

(58) Field of Classification Search
CPC ..... B65B 59/001; B65B 59/003; B65B 7/20; B65B 2210/04; B65B 61/00
See application file for complete search history.

(56) References Cited

U.S. PATENT DOCUMENTS 3,953,956 A * 5/1976 Massman ..... B65B 59/003 53/208
7,337,595 B2 * 3/2008 Harding ..... B65B 55/20 493/464

(Continued)

FOREIGN PATENT DOCUMENTS

DE 1214134 B 4/1966
DE 2061973 A1 9/1971

(Continued)

OTHER PUBLICATIONS

PCT/EP2020/079211 International Search Report dated Jan. 20, 2021.

(Continued)

*Primary Examiner* — Andrew M Tecco
(74) *Attorney, Agent, or Firm* — Wood Herron & Evans LLP

(57) ABSTRACT

The invention relates to a method for automatically creasing a folded box having inserted packaged goods, wherein the side walls of the folded box are creased by means of a creasing station which comprises a creasing tool having a rotatably mounted creasing roller for creasing a planar workpiece and a rotatably mounted counter-pressure roller which are retained at one end on a common support, wherein the distance between the two rollers can be varied, wherein the creasing tool is fastened to a movement system for three-dimensional displaceability, and wherein the following steps are carried out: a) providing the folded box, which is open at the top in the vertical direction and has inserted packaged goods; b) determining the dimensions of the folded box and the filling height of the packaged goods; c) creasing the side walls of the folded box, a first side wall being creased at a first creasing height associated with the filling height determined in step b). The counter-pressure roller is mounted parallel to the creasing roller; the counter- (Continued)

pressure roller and the creasing roller can be displaced relative to one another in order to set a distance from one another; and, during the creasing process, when the creasing tool reaches a vertical edge of the folded box, the roller located outside the folded box is pivoted through 90° about the roller located inside the folded box, the distance between the creasing roller and the counter-pressure roller being changed.

7 Claims, 4 Drawing Sheets

(56) References Cited

U.S. PATENT DOCUMENTS

| | | | | |
|---|---|---|---|---|
| 10,633,136 | B2 * | 4/2020 | Dominici | B65B 7/20 |
| 10,954,018 | B2 * | 3/2021 | Benterman | B26D 1/245 |
| 11,661,227 | B2 * | 5/2023 | Benterman | B26D 1/305 493/309 |
| 2014/0013709 | A1 * | 1/2014 | Ceyssens | B65B 7/28 53/285 |
| 2015/0119216 | A1 * | 4/2015 | Benterman | B26D 5/007 493/309 |
| 2017/0001746 | A1 * | 1/2017 | Dominici | B65B 61/00 |

FOREIGN PATENT DOCUMENTS

| | | | |
|---|---|---|---|
| DE | 2550284 | A1 | 8/1976 |
| DE | 69405954 | T2 | 3/1998 |
| DE | 102012004208 | B4 | 4/2016 |
| EP | 185424 | A1 | 6/1986 |
| EP | 0585613 | B1 | 10/1996 |
| EP | 2684802 | A1 | 1/2014 |
| EP | 3284687 | A1 | 2/2018 |
| WO | 2016151310 | A1 | 9/2016 |

OTHER PUBLICATIONS

German App. No. 10 2019 129 790.7 Office Action dated May 29, 2020.

* cited by examiner

METHOD FOR AUTOMATICALLY CREASING A FOLDED BOX HAVING INSERTED PACKAGED GOODS

This Application is a US National Phase Application of PCT/EP2020/079211 filed Oct. 16, 2020, which claims the priority benefit of German Patent Application No. 10 2019 129 790.7 filed Nov. 5, 2019, both of which are hereby incorporated by reference herein as if fully set forth in their entirety.

FIELD OF THE INVENTION

The invention relates to a method for automatically creasing a folded box with inserted packaged goods.

PRIOR ART

Millions of folded boxes are packed with packaged goods and shipped in the form of packages daily in Germany and other countries. Here, packaged goods are often shipped in oversized folded boxes. In order to prevent possible transport damage of the packaged goods in oversized folded boxes, the empty spaces of the folded boxes provided with packaged goods are regularly packed with filling material such as bubble wrap or paper. The sender thus has to expend additional costs for filling material which the end customer usually immediately discards again after receiving the packaged goods. In addition, in many countries the shipping costs for packages are calculated based on the weight and volume of the package, so that, in the packaging and shipping logistics, there is great interest in shipping packaged goods in folded boxes, the volume of which is adjusted to the volume of the packaged goods.

In order to achieve this, on the one hand, folded boxes of different formats with different dimensions are used. The volume of the folded box is advantageously selected to be as small as possible for the individual packaged goods. On the other hand, attempts have been made to reduce the empty spaces with folded boxes packed with packaged goods, in that the unused volume above the packaged goods, which is delimited by the cover flaps of the folded box, is reduced.

Thus, known from DE 10 2012 004 208 B4 is a method for automatically closing a folded box with inserted packaged goods in a closing machine, wherein packaged goods are inserted in a folded box which is open in the vertical direction at the top and which has multiple circumferential creases (folded edges) which are pre-imprinted at different heights. Subsequently, the folded box is cut at the vertical edges thereof up to a crease associated with the filling height of the packaged goods, the side walls are folded on said crease, and the folded box is closed by means of the cover flaps formed in this way.

In the known method, it is disadvantageous that, in folded boxes with pre-imprinted creases, which were already introduced into the unfolded folded box blank before the folding and the packing of the folded box, the height of the folded box can be adjusted only under some conditions to the filling height of the inserted packaged goods. Depending on the packaged goods to be packed, the filling height can vary considerably, and filling material has to be inserted not only on the side but also above the packaged goods in order to prevent the packaged goods from moving back and forth in the oversized folded box.

Known from EP 3 284 687 A1 is a method for adapting the volume of a folded box to the volume of the packaged goods in which not the height, but the depth of the folded box is adapted to the one of the packaged goods. For this purpose, a folded box is pre-folded such that a bottom and three side walls are formed. The packaged goods are placed into the folded box which is open on one side and at the top, wherein they are pushed completely to the side wall opposite to the open side. Then, the bottom and the two side walls adjoining the open side are creased, wherein the crease is imprinted directly next to the packaged goods. In a next step, the bottom and side flaps defined this way are folded together such that a folded box which is open at the top in the vertical direction results. Finally, a lid is placed on the folded box. It is not disclosed how exactly the creasing process is carried out and which creasing tools are suitable for this.

An alternative method, in which a folded box is first creased in the state packed with packaged goods at a crease height associated with the filling height of the packaged goods, is disclosed in EP 2 185 424 B1.

Here, it is disadvantageous that, to date, no creasing tool for creasing a folded box with inserted packaged goods exists, by which folded boxes of different dimensions can be creased rapidly and correctly one after the other in the corner regions as well.

US 2015/0119216 A1 discloses a method according to the preamble for automatic creasing of a folded box with inserted packaged goods. Creasing of the side walls of the folded box is performed by means of a creasing station which comprises a creasing tool with a rotatably mounted creasing roller and a rotatably mounted counter-pressure roller. The creasing roller has a profile for imprinting a crease at its circumference transversely to its longitudinal axis, the counter-pressure roller has a counter profile which is complementary to the profile of the creasing roller at its circumference. One of the rollers is fixed to a stiff arm and the other roller is fixed to a foldable arm such that the distance between the roller and the counter-pressure roller can be set by a pivoting movement of the foldable arm. The two arms are held on a common holder and the holder is fastened to a movement system for three-dimensional displaceability. For creasing a folded box, a folded box which is open at the top in the vertical direction with inserted packaged goods is provided first. Then, the dimensions of the folded box and the filling height of the packaged goods are established. Afterwards, the side walls of the folded box are creased at a creasing height assigned to the established filling height, wherein a side wall of the folded box is clamped between the creasing roller and the counter-pressure roller and the two rollers circumscribe all sidewalls of the folded box without any repeated opening and closing movements such that one single, circumferential crease is created.

A disadvantage of the known method is that during the creasing process, the corners of the folded box are pushed in. Additionally, setting the distance between the two rollers is made in a disadvantageous manner by a pivoting movement of the roller whose position is mobile. In particular in the case of folded boxes with a larger wall thickness, this leads to the fact that the profile of the creasing roller and the counter profile of the counter-pressure roller which is complementary thereto are arranged at exactly the same height and therefore no proper creases can be imprinted into the side walls of a folded box.

Various creasing tools for creasing different materials and workpieces are known. For example, DE 2 061 973 discloses a creasing tool for creasing flat workpieces made of cardboard with a rotatably mounted creasing roller and with a counter-pressure roller rotatably mounted parallel to the creasing roller, which have a fixed distance from one another and are respectively retained on both sides.

In the known device, it is disadvantageous that the creasing tool is not suitable for creasing a folded box with already inserted packaged goods.

A creasing tool which is suitable for creasing a folded box with inserted packaged goods is known from DE 25 50 284. The creasing tool includes a set of pressing plates and pressing elements, wherein for each side wall of the folded box a respective pressing plate and pressing element are provided. For creasing the folded box at a crease height associated with the filling height of the inserted packaged goods, the pressing plates are introduced in horizontal position along the insides of the side walls into the folded box and there lie flat on the surface of the packaged goods. Each pressing plate has an outer edge for impressing a crease in cooperation with the associated pressing element which is arranged on the outside of the side wall. By pressing the pressing elements against the fixed pressing plates, a crease is impressed into the side walls arranged between the pressing elements and pressing plates.

Here, it is disadvantageous that the arrangement of the pressing plates is secured on a frame which can only be moved vertically, so that the device is suitable only for creasing folded boxes of a certain size. If folded boxes with other dimensions are to be creased, screws have to be loosened, and the arrangement of the pressing plates has to be changed. The use of this device for creasing folded boxes of different sizes is thus complicated and cumbersome. In addition, the pressing plates for the creasing process should come to lie on the packaged goods, so that the creasing tool is primarily used for creasing folded boxes in which flat packaged goods, for example, stacked sheets or tiles, are inserted.

An alternative creasing tool according for creasing or beading thin metal sheets is disclosed in EP 0 585 613 B1. The creasing tool includes a rotatably mounted creasing roller for creasing a flat workpiece and a counter-pressure roller rotatably mounted parallel to the creasing roller, which are retained on one side on a common holder so that they can be moved with respect to one another for setting a mutual distance.

In this known creasing tool, it is disadvantageous that the creasing tool is fastened to a machine stand in such a way that the longitudinal axes of the creasing roller and the counter-pressure roller are oriented horizontally, so that the tool is not suitable for creasing a folded box which is open at the top and contains already inserted packaged goods. Instead, a flat workpiece has to be moved between the creasing roller which is in a fixed position during the creasing process and the counter-pressure roller.

From EP 2 684 802 A1, a scoring tool for scoring the side walls of a folded box with inserted packaged goods at the filling height is known. Through the scoring, lid flaps are defined, which can be easily folded and can close the folded box. The scoring tool comprises four scoring rollers and a vertically displaceable support means with four counter-pressure plates, wherein respectively one scoring roller and one counter-pressure plate is assigned to each side wall of the folded box. One respective scoring roller is positioned on the outside of a side wall of the folded box filled with packaged goods. The support means is inserted up to the folded box, wherein the four counter-pressure plates respectively lie against the inner side of a side wall over the full length. Each one of the scoring rollers has a rotating knife disc which cuts into the outer side of the side wall of the folded box during the scoring process, while the counter-pressure plate creates counter-pressure at the opposite inner side of the side wall of the folded box.

A disadvantage of this tool is that the side walls are scored. Through the scoring, the stacking capability of the boxes is reduced as it is more difficult for them to accept pressure loads from above. Additionally, the parts of the side walls which are to serve as lid flaps can tear if the side walls are scored too deep during the scoring process. Furthermore, the device is not suited for the processing of folded boxes of different dimensions due to the fixed size of the counter-pressure plates.

WO 2016/151310 A1 discloses a device for adapting the volume of a folded box to the volume of its packaged goods with two creasing stations which are built up analogously. Each creasing station comprises a creasing tool where two respective creasing pliers are held on a common holder in a horizontally displaceable manner. The two common held creasing pliers are assigned to corners of a folded box which are opposite to one another. Each creasing plier has two gripping jaws corresponding to one another with a perpendicular outer or inner edge between which the corner of a folded box can be clamped such that with sufficient pressure, a crease is created.

A disadvantage of creasing a folded box with this known method is that the folded box has to pass through two creasing stations in order for a crease to be imprinted in all side walls. Additionally, the device is not suited for creasing folded boxes with different dimensions. In order to be able to imprint a circumferential crease into the four side walls of the folded box with this known device, the width of each side wall must be at least the single and not more than the double length of the outer or inner edges of the creasing pliers.

All the known creasing tools and methods for creasing a folded box have not yet been optimally designed.

AIM

Therefore, the aim of the present invention is to propose a method for automatically creasing a folded box with inserted packaged goods, which enables a rapid, correct creasing of the side walls of folded boxes with different dimensions without the corner regions of the folded box being pushed in during the creasing.

DESCRIPTION OF THE INVENTION

The aim is achieved in connection with the features of the preamble of claim 1, in that the counter-pressure roller is mounted parallel to the creasing roller, that the counter-pressure roller and the creasing roller can be displaced with regard to one another for setting a distance to one another, and that during the creasing process, when the creasing tool reaches a vertical edge of the folded box, the roller arranged outside the folded box is pivoted by 90° about the roller arranged inside the folded box, wherein the distance between the creasing roller and the counter-pressure roller is changed.

According to the invention, during the creasing process, when the creasing tool reaches a vertical edge of the folded box, the roller arranged outside of the folded box is pivoted by 90° about the roller arranged within the folded box, wherein the distance between the creasing roller and the counter-pressure roller is changed. Here, for example, during the pivoting between 0° and 45°, the distance is increased, and during the pivoting between 45° and 90°, the distance is reduced again. This enables a rapid, correct creasing of the side walls of the folded box, without the corner regions of the folded box being pushed in during the creasing.

The movement system to which the creasing tool is fastened for three-dimensional displaceability can be designed either as a robot arm or as a rail system. An advantage of the present invention is that, by means of the creasing station, the side walls of folded boxes of different size can be rapidly creased one after the other. Here, the contour of the packaged goods is irrelevant for creasing the side walls by means of the creasing station. Because the creasing roller and the counter-pressure roller are only retained on one side, that is to say retained on only one side, on a common holder, while the opposite ends of the creasing roller and of the counter-pressure roller are free, the creasing tool can be positioned on a side wall of a folded box so that said folded box can be clamped in and creased between the roller and the counter-pressure roller. The setting of the distance between creasing roller and counter-pressure roller can take place pneumatically or by motor. In addition, if necessary, one of the rollers can be actively driven by means of a drive. Preferably, the creasing roller is designed as a rotatable creasing shaft which, on the circumference thereof, transversely with respect to the longitudinal axis thereof, has a profile for impressing a crease.

Alternatively, the creasing roller can include a fixed axle with a rotatable creasing wheel. The counter-pressure roller optionally can comprise, on the circumference thereof, a counter profile complementary to the profile or to the creasing wheel of the creasing roller.

In the method, a folded box which is open in the vertical direction at the top and contains inserted packaged goods is first supplied to the creasing station. For the start of the creasing, the creasing tool is positioned on a side wall of the folded box, wherein the creasing roller is oriented on one side of the side wall and the counter-pressure roller is oriented on the other side of the side wall perpendicularly to the bottom of the folded box. Subsequently, the side wall is clamped between the creasing roller and the counter-pressure roller by reducing the distance between the two rollers. In order to impress a crease in the side walls, the creasing tool then moves around the side walls of the folded box, until it again reaches its starting position and a complete movement around the folded box has taken place and each of the side walls of the folded box has been creased. Subsequently, the distance between the two rollers is increased and the folded box is released.

For the creasing process, the creasing roller is preferably positioned on the inside of the folded box and the counter-pressure roller on the outside, so that the side walls are creased on the inside thereof. This has the advantage that after creasing and folding the cover flaps defined thereby on the outside of the folded box, a clean edge is formed. Due to the flexibility of the creasing station, the side walls, if necessary, can alternatively or additionally be creased on the outside thereof.

Preferred embodiments of the invention are the subject matter of the dependent claims.

In an embodiment, the side wall opposite the first side wall is creased at the first crease height, and the side walls adjacent to the first side wall are creased at a second crease height which is offset by the wall thickness determined in step b) in the vertical direction with respect to the first crease height. If all the side walls of a folded box are creased at the same crease height, then, when the cover flaps defined thereby are folded in, restoring forces act on the cover flaps, which lead to the cover flaps flapping back open after they are folded in if no force opposes the flapping open. The creases of a pair of mutually opposite side walls of a folded box at a crease height other than that of the creases of the adjacent side walls have the advantage that the restoring forces acting on the cover flaps are reduced. The creases of the mutually adjacent side walls with vertical offset by only a wall thickness moreover ensures that the unused volume above the packaged goods, due to the creasing at two different heights, is not unnecessarily large.

Alternatively, from the filling height of the packaged goods determined in step b), it can be calculated whether, during a creasing of the first side wall and of the side wall opposite the first side wall at the first crease height, a later cutting of the folded box at its vertical edges up to the first crease height and a folding in of the first side wall and of the side wall opposite the first side wall at the first crease height will or will not lead to an overlapping of the first side wall and of the side wall opposite the first side wall, and, in the case in which no overlap is calculated, the side wall opposite the first side wall is creased at the first crease height and, in the case in which an overlap is calculated, the side wall opposite the first side wall is creased at a second crease height which is offset in the vertical direction by the wall thickness determined in step b) with respect to the first crease height. In this way, the restoring forces acting on the cover flaps during the folding in are further minimized.

In order to further minimize the restoring forces acting on the cover flaps during folding in, it can additionally be calculated whether, when the side wall adjacent to the first side wall is creased at a third crease height which is not the same as the first crease height and not the same as the second crease height, and which is offset in the vertical direction by the wall thickness determined in step b) with respect to these crease heights, a later cutting of the folded box at the vertical edges thereof up to the first crease height and a folding in of the side wall adjacent to the first side wall at the third crease height will or will not lead to an overlapping of the side wall adjacent to the first side wall, and in the case in which no overlap is calculated, the side wall adjacent to the first side wall is creased at the third crease height, and, in the case in which an overlap is calculated, a side wall adjacent to the first side wall is creased at the third crease height, and the other side wall adjacent to the first side wall is creased at a fourth crease height which is not the same as the first, second and third crease heights and which is offset in the vertical direction with respect to said crease heights by the wall thickness determined in step b).

According to the invention, it is provided that the creasing of the side walls of the folded box takes place by means of a creasing station which comprises a creasing tool with a rotatably mounted creasing roller for creasing a flat workpiece and a counter-pressure roller which is rotatably mounted parallel to the creasing roller which are held on one side on a common holder displaceable with regard to one another for setting a distance to one another, wherein the creasing tool is fastened to a movement system for three-dimensional displaceability. In fact, the creasing of the side walls of the folded box at different crease heights offset in each case by a wall thickness can take place using conventional creasing tools. However, it is particularly advantageous if the creasing takes place by means of a described creasing station, since said creasing station is suitable for rapidly creasing one after the other multiple folded boxes which are open at the top in the vertical direction, which can have different dimensions and which can be packed with different packaged goods.

Moreover, it is preferably provided that, based on the wall thickness of the side walls of the folded box, which is determined in step b), a distance between the creasing roller and the counter-pressure roller suitable for creasing the side walls is determined. Depending on the wall thickness, more or less force has to be exerted in order to crease the side walls of the folded box. Due to the fact that the distance between the two rollers is set as a function of the wall thickness, impressing the crease too deeply and possible tearing off of the cover fold are prevented. In addition, the need for the creasing to move around the folded box multiple times in order to impress a crease in each of the side walls is prevented.

It is particularly advantageous if, during the creasing process, the folded box is retained in position by holding means. In this way, the folded box cannot slip during the creasing process. The holding means can be designed, for example, as a vacuum cup.

Additional details and advantages of the invention result from the following special description and from the drawings.

DESCRIPTION OF PREFERRED EMBODIMENTS

Figure 1:
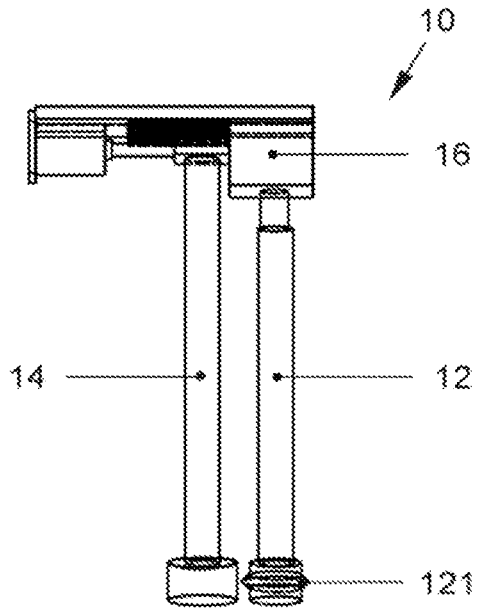
FIG. 1: a perspective representation of a creasing tool for a creasing station according to the invention for automatically creasing a folded box with inserted packaged goods.

Identical reference numerals in the figures refer to identical or analogous elements.

FIG. 1 shows an embodiment of a creasing tool 10 for a creasing station for automatically creasing a folded box with inserted packaged goods. The creasing roller 12 and the counter-pressure roller 14 are retained on one side on a common holder 16, wherein the distance between the two rollers 12, 14 can be changed. The opposite ends of the creasing roller 12 and of the counter-pressure roller 14 are free, so that a side wall of the folded box can be clamped in between the rollers 12, 14 and creased. In the embodiment shown, the creasing roller 12 is designed as a rotatable creasing shaft which, on the circumference thereof, transversely to the longitudinal axis thereof, has a profile for impressing a crease in the form of an impressing ring 121. Alternatively, the creasing roller 12 can include a fixed axle with a rotatable creasing wheel (not shown here). The counter-pressure roller 14 can have, on the circumference thereof, a counter-profile complementary to the profile or to the creasing wheel of the creasing roller (not shown here).

Figure 2:
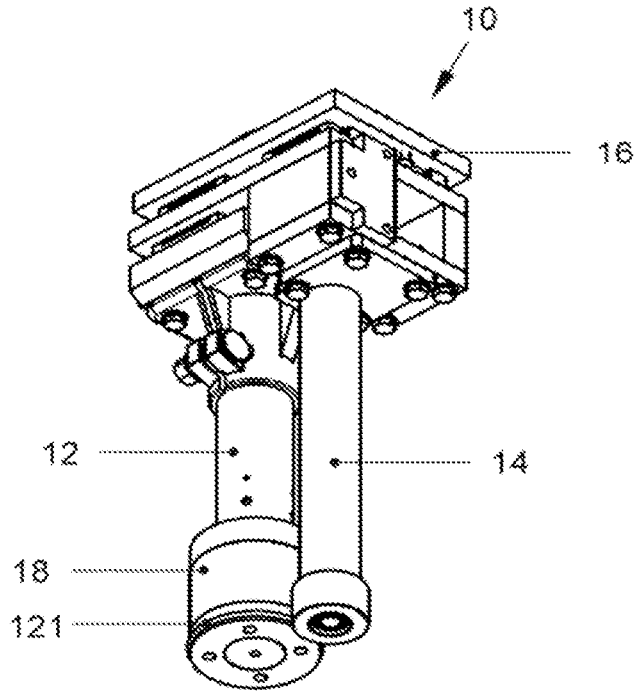
FIG. 2: a perspective representation of an alternative embodiment of a creasing tool.
Figure 4:
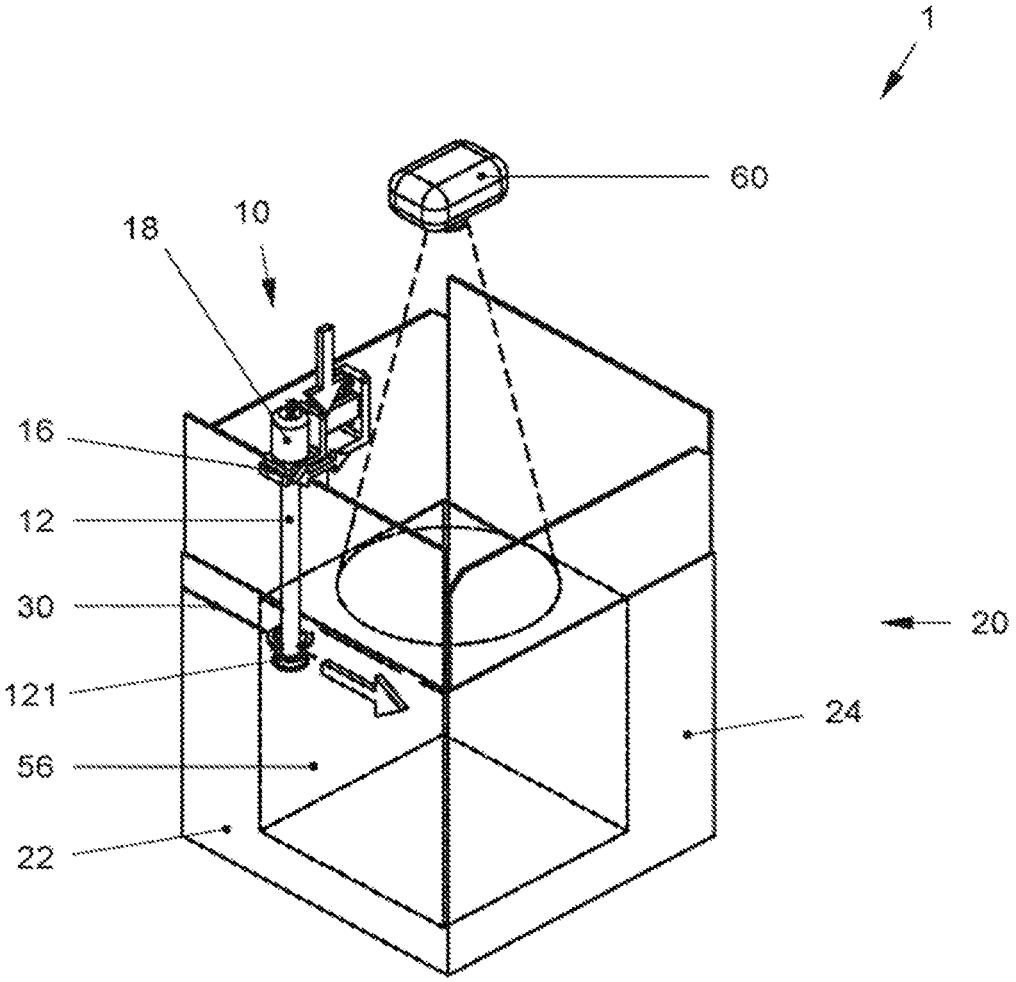
FIG. 4: a perspective representation of the creasing process with a creasing tool.

In addition, one of the rollers 12, 14 can be actively driven by means of a drive 18, such as the alternative embodiment of a creasing tool, represented in FIG. 2, for a creasing station for automatically creasing a folded box with inserted packaged goods. As shown in FIG. 2, the drive 18 can be arranged at the free end or, as shown in FIG. 4, at the retained end of the creasing roller 12. Additionally or alternatively, it is also conceivable to drive the counter-pressure roller 14 by means of a drive 18 (not shown here).

Figure 3:
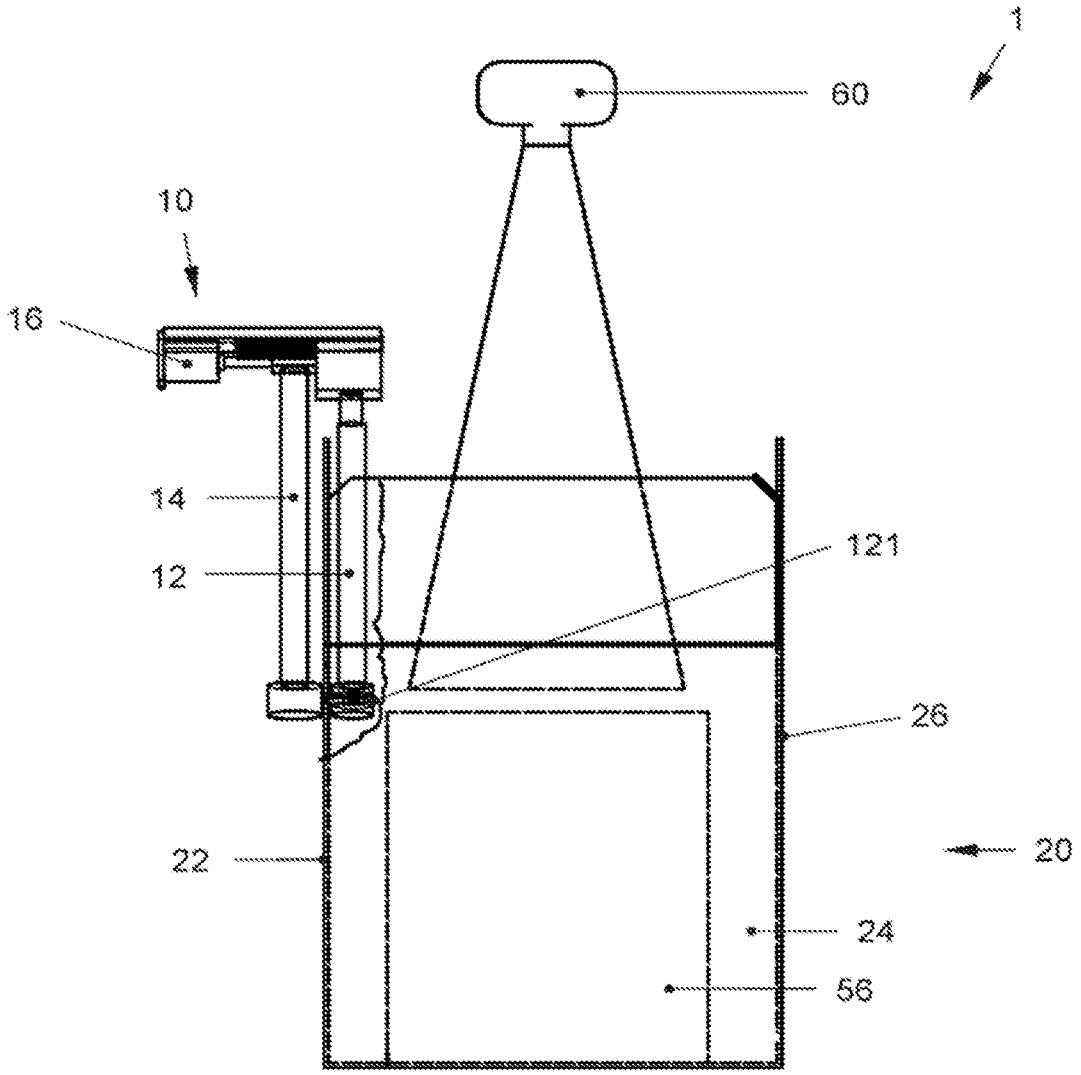
FIG. 3: positioning the creasing tool according to FIG. 1 on a side wall of a folded box.

FIG. 3 shows the positioning of the creasing tool 10 of FIG. 1 on a side wall 22 of a folded box 20. By means of an optical measuring device 60, the filling height of the packaged goods 56 inserted in a folded box 20 which is open at the top in the vertical direction and the dimensions of the folded box 20 are determined. Then, the creasing tool 10 is positioned by means of a robot arm or a rail system (not shown here) on a side wall 22 of the folded box 20 so that the creasing roller 12 on one side of the side wall 22 and the counter-pressure roller 14 on the other side of the side wall 22 are oriented perpendicularly to the bottom of the folded box 20. By reducing the distance between the two rollers 12, 14, the side wall 22 is clamped in between the creasing roller 12 and the counter-pressure roller 14. Preferably, the creasing roller 12 is positioned on the inside of the holding box 20 and the counter-pressure roller 14 is positioned on the outside so that the side walls are creased on their inside.

Alternatively, the creasing roller 12 can be positioned on the outside and the counter-pressure roller 14 can be positioned on the inside of the folded box 20, as shown in FIG. 4. FIG. 4 shows the creasing of a side wall 22, wherein the creasing tool 10 moves along the side wall 22 at a first crease height associated with the filling height of the packaged goods 56. In the embodiment shown here, the creasing roller 12 is driven by means of a drive 18 arranged on the retained end of the creasing roller 12. Advantageously, the folded box 20 is retained in position during the creasing process by holding means (not shown here).

Figure 5:
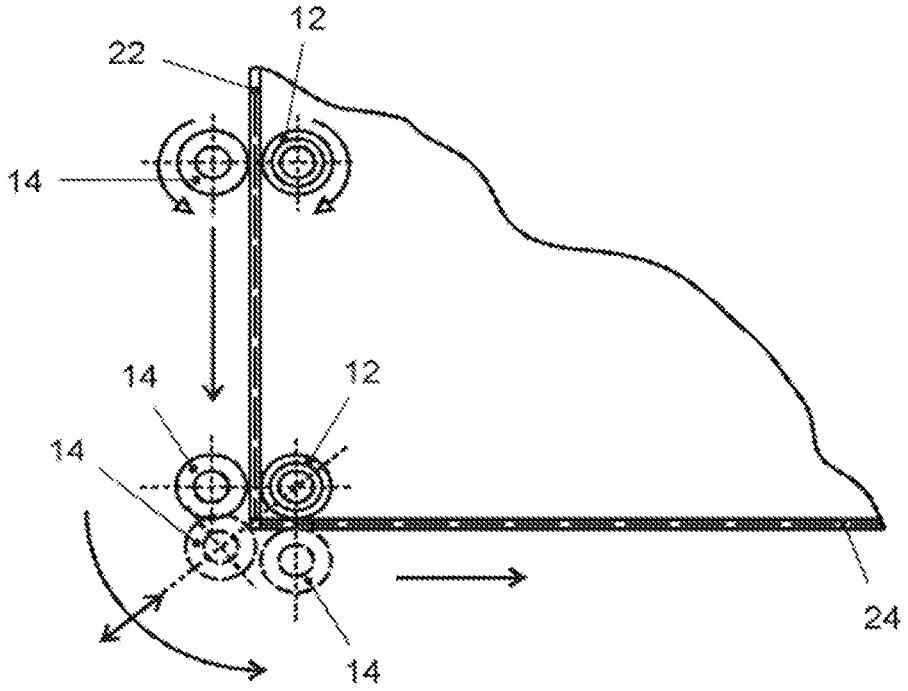
FIG. 5: a diagrammatic top view onto a creasing process, when the creasing tool has reached a vertical edge of the folded box.

FIG. 5 shows the creasing process according to the invention in the corner region of the folded box 20. When the two rollers 12, 14 of the creasing tool 10 reach a vertical edge of the folded box 20, where two side walls 22, 24 meet, the roller 14 arranged outside of the folded box 20 is pivoted by 90° about the roller 12 arranged within the folded box 20, wherein the distance between the creasing roller 12 and the counter-pressure roller 14 is changed, so that the corner regions of the folded box 20 are not pushed in during the creasing. Here, during the pivoting between 0° and 45°, the distance is increased, and during the pivoting between 45° and 90°, said distance is again decreased.

Naturally, the embodiments discussed in the specific description and shown in the figures represent only illustrative embodiment examples of the present invention. In view of this disclosure, the person skilled in the art is provided with a broad spectrum of variation possibilities.

LIST OF REFERENCE NUMERALS

1 Creasing station
10 Creasing tool
12 Creasing roller
121 Impressing ring
14 Counter-pressure roller
16 Holder
18 Drive
20 Folded box
22, 24, 26 Side walls of 20
30 First crease height
56 Packaged goods
60 Optical measuring device

The invention claimed is:

1. A method for automatically creasing a folded box with inserted packaged goods, wherein the creasing of the side walls of the folded box takes place by means of a creasing station which comprises a creasing tool with a rotatably mounted creasing roller for creasing a flat workpiece and a rotatably mounted counter-pressure roller which are held on a common holder on one side, wherein the distance between the two rollers can be changed, wherein the creasing tool is fastened to a movement system for three-dimensional displaceability, and wherein the following steps are carried out:

a) providing the folded box which is open at the top in the vertical direction and which contains inserted packaged goods, b) determining the dimensions of the folded box and the filling height of the packaged goods, c) creasing the side walls of the folded box, wherein a first side wall is creased at a first crease height associated with the filling height determined in step b), wherein the counter-pressure roller is mounted parallel to the creasing roller, wherein the counter-pressure roller and the creasing roller are displaceable with regard to one another for setting a distance to one another, and wherein, during the creasing process, when the creasing tool reaches a vertical edge of the folded box, the roller arranged outside of the folded box is pivoted by 90° about the roller arranged inside the folded box, wherein the distance between the creasing roller and the counter-pressure roller is changed.

2. The method according to claim 1, wherein:

in step b), from the exterior dimensions of the folded box, measured by means of an optical measuring device, a wall thickness of the side walls is determined by comparison with data stored in a data memory.

3. The method according to claim 2, wherein:

the side wall opposite the first side wall is creased at the first crease height and the side walls adjacent to the first side wall are creased at a second crease height which is offset in the vertical direction by the wall thickness determined in step b) with respect to the first crease height.

4. The method according to claim 2, wherein:

from the filling height of the packaged goods determined in step b), it is calculated whether, during a creasing of the first side wall and of the side wall opposite the first side wall at the first crease height, a later cutting of the folded box at its vertical edges up to the first crease height and a folding in of the first side wall and of the side wall opposite the first side wall at the first crease height will or will not lead to an overlapping of the first side wall and of the side wall opposite the first side wall, and, in the case in which no overlap is calculated, the side wall opposite the first side wall is creased at the first crease height and, in the case in which an overlap is calculated, the side wall opposite the first side wall is creased at a second crease height which is offset in the vertical direction by the wall thickness determined in step b) with respect to the first crease height.

5. The method according to claim 4, wherein:

it is calculated whether, during a creasing of the side wall adjacent to the first side wall at a third crease height which is not the same as the first crease height and not the same as the second crease height, and which is offset in the vertical direction by the wall thickness determined in step b) with respect to these crease heights, a later cutting of the folded box at the vertical edges thereof up to the first crease height and a folding in of the side walls adjacent to the first side wall at the third crease height will or will not lead to an overlapping of the side walls adjacent to the first side wall, and in the case in which no overlap is calculated, the side walls adjacent to the first side wall are creased at the third crease height, and, in the case in which an overlap is calculated, a side wall adjacent to the first side wall is creased at the third crease height, and the other side wall adjacent to the first side wall is creased at a fourth crease height which is not the same as the first, second and third crease heights and which is offset in the vertical direction with respect to said crease heights by the wall thickness determined in step b).

6. The method according to claim 2, wherein:

on the basis of the wall thickness of the side walls of the folded box, which is determined in step b), a distance suitable for creasing the side walls between the creasing roller and the counter-pressure roller is determined.

7. The method according to claim 1, wherein:

during the creasing process, the folded box is retained in position by holding means.

* * * * *